US005417372A

United States Patent [19]

Portugal

[11] Patent Number: 5,417,372

[45] Date of Patent: May 23, 1995

[54] FOAM AND FIBER SPRAY GUN APPARATUS

[75] Inventor: Carlos Portugal, Oceanside, Calif.

[73] Assignee: McDonnell Douglas Corporation, Huntington Beach, Calif.

[21] Appl. No.: 800,283

[22] Filed: Nov. 29, 1991

[51] Int. Cl.[6] ..... B05B 7/26

[52] U.S. Cl. ..... 239/428; 239/432

[58] Field of Search ..... 239/425, 8, 9, 432

[56] References Cited

U.S. PATENT DOCUMENTS

| | | | |
|---|---|---|---|
| 2,850,421 | 9/1958 | Thompson | 239/428 |
| 3,458,138 | 7/1969 | Yankee | 239/428 |
| 3,535,151 | 10/1970 | Raffel et al. | 239/428 X |
| 3,790,030 | 2/1972 | Ives | 239/432 X |
| 3,873,023 | 3/1975 | Moss et al. | 239/9 X |
| 4,193,546 | 3/1980 | Hetherington et al. | 239/432 X |
| 4,760,956 | 8/1988 | Mansfield | 239/432 X |
| 5,093,058 | 3/1992 | Harmon et al. | 239/432 X |

*Primary Examiner*—Andres Kashnikow
*Assistant Examiner*—Kevin P. Weldon
*Attorney, Agent, or Firm*—Donald E. Stout; John P. Scholl

[57] ABSTRACT

Apparatus for uniformly blending and applying a mixture of a two part resin and radar absorbing fibers to a surface. The fibers retain their length distribution after mixing and application. The unreacted resin base and catalyst components of the resin, one or both of which are premixed with the fibers, are brought together in a dispenser which then conducts them to an in line motionless mixer element and from there to a nozzle which has an output orifice sufficient for the desired length of the fibers to retain the desired size distribution of the fibers in the applied resin. The apparatus is also capable of applying other types of fibers or other solid materials within the liquid polymer matrix with minimal breakage to the solid component.

20 Claims, 1 Drawing Sheet

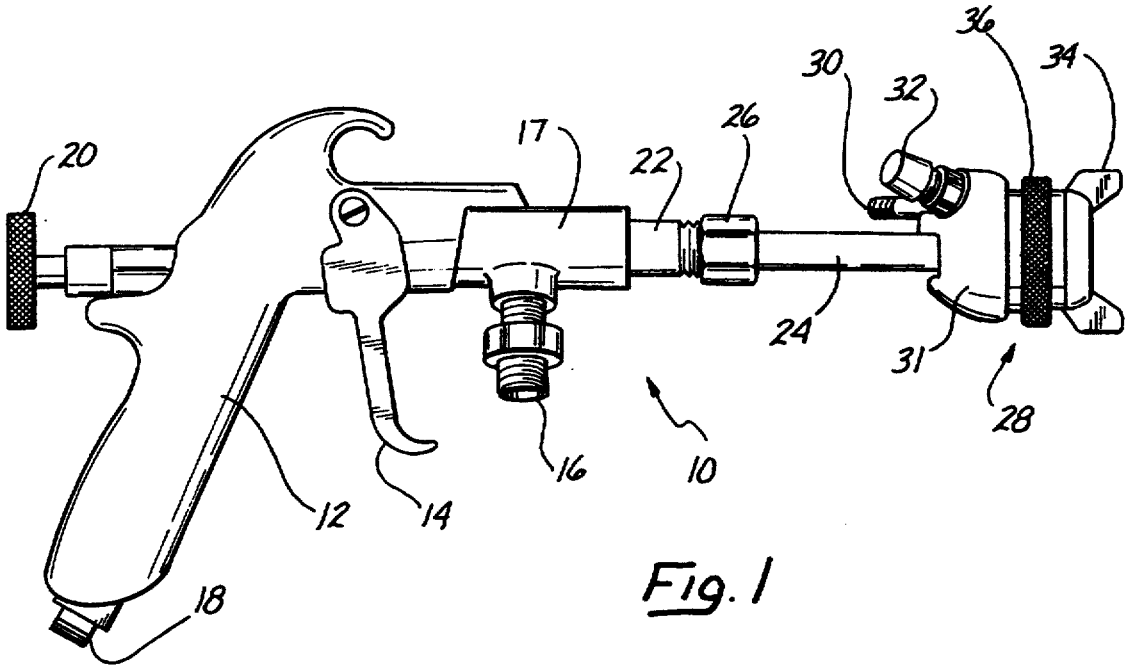
Fig. 1
Fig. 2
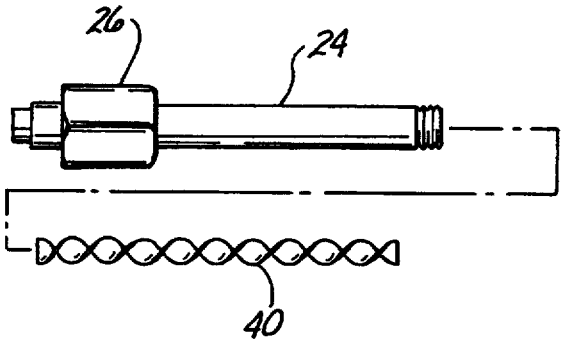
Fig. 3
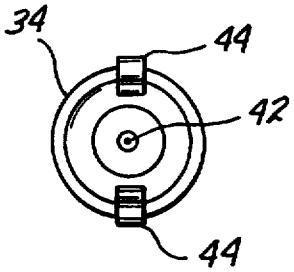

FOAM AND FIBER SPRAY GUN APPARATUS

BACKGROUND OF THE INVENTION

This invention relates to apparatus for mixing and spraying a mixture of the two parts of a resin system and a fiber onto a surface.

The art is replete with a variety of spray guns that can either be combined with, or have as integral subassemblies thereof, choppers to cut fiberglass roving into short lengths for combination with the sprayed on resin to form a fiberglass reinforced plastic layer. Reference can be made to U.S. Pat. No. 4,081,904 to Krohn, et al., which discusses several different types of such spray guns. However, these fibers do not need to be of precisely controlled lengths nor do they need to be of particularly uniform distribution in the resulting layer. Also, these sprayers combine the fibers with the resin after the two parts of the resin have been mixed and downstream of the exit nozzle of the spray gun. If a very fine fiber were to be introduced into the spray gun upstream of its internal mixing means, it would either clog the spray gun or break up the small fibers and randomize their length distribution in the resulting sprayed on layer. There is no known spray gun apparatus that can apply the resin/fiber system contemplated herein while retaining the desirable length distribution of the fibers in the applied layer.

BRIEF SUMMARY OF THE INVENTION

The apparatus of this invention is supplied with the unreacted resin base and the catalyst, hereinafter the A and B components, either or both of which are premixed with the fiber in pressurized feedlines which enter into and initially combine within a dispenser means which controls the flow of the components through the apparatus. The components are conveyed out of the dispenser into a mixer stage which contains an in-line motionless mixer element to uniformly mix and combine the constituents. These mixed constituents leave the apparatus via a nozzle means which is also supplied with high pressure air to propel the mixture onto the surface to be coated. The aperture of the nozzle is carefully sized to be at least 10% larger in diameter than the desired length of the fibers. Careful design of the fluid pathway within the apparatus minimizes opportunities for the fibers to be broken into smaller pieces and undesirably randomize the length distribution of the fibers in the layer. The fibers comprise, in the preferred embodiment, dielectric substance whose resistivity, aspect ratio of diameter to length, and absolute length are carefully tailored to absorb electromagnetic radiation within a relatively narrow bandwidth in the radar portion of the spectrum. The performance of the layer is optimized if the majority of the fibers in the layer remain at their intended lengths and are not broken by the mixing and application process. Other fibers could be used to optimize other characteristics of the applied polymer/foam layer as well as other solid materials such as microballoons and other filler particulates whose performance will be optimized by minimizing breakage during the mixing and application steps.

BRIEF DESCRIPTION OF THE DRAWINGS

FIG. 1 is a side view of the apparatus of this invention;

FIG. 2 is a side view of the mixing means of the apparatus, showing the internal in-line, motionless mixing element; and FIG. 3 is an end view of the nozzle, showing its central orifice and the adjustment means to control the spray pattern.

DETAILED DESCRIPTION OF THE INVENTION

What follows is a description of one implementation of the apparatus of this invention. The true scope of the invention is defined by the claims set forth below. FIG. 1 is a right side of the spray gun 10. The dispenser portion 12 is adapted from a conventional plural head dispenser available from Binks, a well known supplier of fluid handling systems. There are three fluid inlets into the dispenser, an A component inlet fitting 16, a B component fitting not shown which is hidden by the A fitting 16, and a solvent fitting to supply a solvent such as MEK to flush out and clean the internal workings of the spray gun, also not shown but located between the A and B fittings. The A and B component inlet fittings normally are supplied with check valves containing balls. These balls should be removed to reduce the opportunity for breakage of the fibers. A trigger means 14 controls the on and off for the A and B components via valves, not shown, within the valve body 17. Knob means 20 controls solvent flush. Switch 18 is a solenoid which controls the pressurization and depressurization of material from a PluralComp unit which supplies the components to the spray gun. An outlet fitting 22 is externally threaded to accept an internally threaded compression connector 26 on the left end, as shown, of the mixer tube 24. The outlet end of the mixer tube 24 is threaded and screwed into the housing 31 of a modified DeVilbiss spray tip nozzle assembly 28. The nozzle housing 31 was modified to accept high pressure air by drilling and tapping a ⅜" hole to accept an inlet fitting 30 whose flow is controlled by valve 32. Valve 32 also controls the fan size of the spray output pattern. The nozzle orifice, not shown in this view, is located in the adjustable orifice assembly 34 which screws into the housing 31 by turning the knurled ring 36.

FIG. 2 is an exploded side view of the mixer showing the compression fitting 26, the mixing tube 24 and the stationary mixing element 40 which is contained within the mixing tube 24. FIG. 3 is a right end view of the spray gun 10 showing the adjustable orifice assembly 34 with the central orifice 42 and the protrusions 44 which rotate to adjust the output spray fan pattern from the nozzle. As discussed above, the diameter of the orifice 42 should be at least 20% greater than the length of the fibers or other critical dimension of the solid constituent to minimize breakage thereof. For the preferred embodiment the orifice diameter maximum is about 0.110" and the minimum is about 0.030".

BEST MODE OF PRACTICING THE INVENTION

A radar absorbing polymer layer was fabricated in the following fashion. Separate A and B components, urethane base and catalyst, were pumped under low pressure to the apparatus of this invention. The two resin system components were each premixed with the fibers and were then conveyed through the spray gun apparatus at a maximum pressure of about 200 psi. The fibers were AV PC60D Type E 35A from Textron having a specified cut length of 0.060 inches. The diameter of the orifice in the nozzle was 0.110 inches for best results, with 0.080 inches being the minimum diameter that produced acceptable results for this fiber length. As supplied from Textron and before any processing, these fibers had the following size distribution: about 60% fell into the 60–71 rail length range, about 30% fell into the 48–59 mil range, about 1% in the 36–47 mil range, about 4% in the 24–35 mil range, about 4% in the 12–23 mil range, and about 1% in the 0–11 mil range. After mixing and application according to this invention, analysis of fiber lengths in the polymer layer yielded the following size distribution: about 40% in the 60–71 mil range, about 28% in the 48–59 mil range, about 11% in the 36–59 mil range, about 13% in the 24–35 mil range, about 7% in the 12–23 mil range, and about 1% in the 0–11 mil range. The desirable fiber lengths will occur in the upper two size ranges, 60–71 and 48–59 mils. The degradation from the initial total in these two ranges of about 90% to about 68% as measured in the applied polymer yields acceptable results for radar absorption and indicates that fiber breakage has been minor. Also the uniformity of the thickness of the polymer layer and the lack of clumping of the fibers in the polymer layer were very good.

I claim:

1. A spray gun apparatus for applying a uniformly mixed coating comprising a two component resin system (an unreacted resin base or A component and a catalyst or B component) and fibers of a controlled length distribution, the apparatus comprising:

a first fluid supply inlet adapted to provide the A component of the two component resin system;

a second fluid supply inlet adapted to provide the B component of the two component resin system;

a third fluid supply inlet adapted to provide a pressurized gas;

a dispenser adapted to receive and control the flow of the A and B components, at least one of which is pre-mixed with the fibers;

an in-line motionless mixer element having a twisted configuration and contained within a fluid conduit attached to the output of said dispenser; and a nozzle connected to and adapted to receive the output of said mixer element, said nozzle having an exit orifice at least 20% larger in diameter than the maximum length of the fibers prior to mixing, and further having an inlet adapted to receive said pressurized gas, and a gas control valve adapted to control the quantity of gas exiting from said orifice.

2. The apparatus as recited in claim 1, and further comprising a fourth fluid supply inlet connected to said dispenser and adapted to receive a cleaning solvent.

3. The apparatus as recited in claim 1, and further comprising a gas flow adjustment means for controlling the amount of gas supplied to said nozzle.

4. The apparatus as recited in claim 1, and further comprising a resin flow adjustment means to control the amount of resin mixture leaving the dispenser.

5. The apparatus as recited in claim 1, and further comprising a means for adjusting the spray pattern flowing from said nozzle to thereby control the uniformity of application of the mixture of the resin system and the fibers to a surface.

6. The apparatus as recited in claim 1, wherein said exit orifice is adjustable within a range of between about 0.030 inches and 0.110 inches.

7. A spray gun apparatus for applying a uniformly mixed coating comprising a two component resin system (an unreacted resin base or A component and a catalyst or B component) and fibers of a controlled length distribution, the apparatus comprising:

a first fluid supply inlet adapted to provide the A component of the two component resin system;

a second fluid supply inlet adapted to provide the B component of the two component resin system;

a third fluid supply inlet adapted to provide a pressurized gas;

a dispenser adapted to receive and control the flow of the A and B components, at least one of which is pre-mixed with the fibers;

an in-line motionless mixer element contained within a fluid conduit attached to the output of said dispenser, for mixing the A and B components; and a nozzle connected to and adapted to receive the output of said mixer element, said nozzle having an exit orifice at least 20% larger in diameter than the maximum length of the fibers prior to mixing, and further having an-inlet adapted to receive said pressurized gas, and a gas control valve adapted to control the quantity of gas exiting from said orifice;

wherein said mixer element is upstream of said pressurized gas inlet.

8. The apparatus as recited in claim 7, and further comprising a fourth fluid supply inlet connected to said dispenser and adapted to receive a cleaning solvent.

9. The apparatus as recited in claim 7, and further comprising a gas flow adjustment means for controlling the amount of gas supplied to said nozzle.

10. The apparatus as recited in claim 7, and further comprising a resin flow adjustment means to control the amount of resin mixture leaving the dispenser.

11. The apparatus as recited in claim 7, and further comprising a means for adjusting the spray pattern flowing from said nozzle to thereby control the uniformity of application of the mixture of the resin system and the fibers to a surface.

12. Thee apparatus as recited in claim 7, wherein said exit orifice is adjustable within a range of between about 0.030 inches and 0.110 inches.

13. A spray gun apparatus for fabricating a radar absorbing polymer layer by applying a uniformly mixed coating comprising a two component resin system (an unreacted resin base or A component and a catalyst or B component) and radar absorbing fibers of a controlled length distribution, the apparatus comprising:

a first fluid supply inlet adapted to provide the A component of the two component resin system;

a second fluid supply inlet adapted to provide the B component of the two component resin system;

a third fluid supply inlet adapted to provide a pressurized gas;

a dispenser adapted to receive and control the flow of the A and B components, at least one of which is pre-mixed with the fibers;

an in-line motionless mixer element contained within a fluid conduit attached to the output of said dispenser, for mixing the A and B components; and a nozzle connected to and adapted to receive the output of said mixer element, said nozzle having an exit orifice at least 20% larger in diameter than the maximum length of the fibers prior to mixing, and further having an inlet adapted to receive said pressurized gas, and a gas control valve adapted to control the quantity of gas exiting from said orifice.

14. The apparatus as recited in claim 13, wherein said fibers have at least 60% of their lengths matched to absorb radar energy in a frequency band correlated to the controlled fiber length distribution after application to said surface.

15. The apparatus as recited in claim 13, wherein the resin is urethane base.

16. The apparatus as recited in claim 13, wherein said exit orifice is adjustable within a range of between about 0.030 inches and 0.110 inches.

17. The apparatus as recited in claim 13, and further comprising a fourth fluid supply inlet connected to said dispenser and adapted to receive a cleaning solvent.

18. The apparatus as recited in claim 13, and further comprising a gas flow adjustment means for controlling the amount of gas supplied to said nozzle.

19. The apparatus as recited in claim 13, and further comprising a resin flow adjustment means to control the amount of resin mixture leaving the dispenser.

20. The apparatus as recited in claim 13, and further comprising a means for adjusting the spray pattern flowing from said nozzle to thereby control the uniformity of application of the mixture of the resin system and the fibers to a surface.

* * * * *